US006989039B2

(12) United States Patent
Vuijk

(10) Patent No.: US 6,989,039 B2
(45) Date of Patent: Jan. 24, 2006

(54) CYCLONIC SEPARATING APPARATUS

(75) Inventor: Remco Douwinus Vuijk, Bath (GB)

(73) Assignee: Dyson Limited, Wiltshire (GB)

( * ) Notice: Subject to any disclaimer, the term of this patent is extended or adjusted under 35 U.S.C. 154(b) by 125 days.

(21) Appl. No.: 10/474,684

(22) PCT Filed: Mar. 21, 2002

(86) PCT No.: PCT/GB02/01378

§ 371 (c)(1),
(2), (4) Date: Oct. 14, 2003

(87) PCT Pub. No.: WO02/082966

PCT Pub. Date: Oct. 24, 2002

(65) Prior Publication Data

US 2004/0112018 A1 Jun. 17, 2004

(30) Foreign Application Priority Data

Apr. 12, 2001 (GB) ..... 0109399

(51) Int. Cl.
*B01D 45/12* (2006.01)

(52) U.S. Cl. ..... 55/343; 55/344; 55/347; 55/34; 55/418; 55/DIG. 3

(58) Field of Classification Search ..... 55/343, 55/344, 346, 347, 348, 349, 418, 459.5, DIG. 3
See application file for complete search history.

(56) References Cited

U.S. PATENT DOCUMENTS 1,928,702 A * 10/1933 O'Mara ..... 55/338
2,866,518 A * 12/1958 Lincoln ..... 55/344
3,425,192 A 2/1969 Davis
4,711,720 A 12/1987 Young
2005/0102982 A1 * 5/2005 Dummelow et al. ..... 55/428

FOREIGN PATENT DOCUMENTS

| | | |
|---|---|---|
| EP | 0 018 197 A1 | 10/1980 |
| EP | 0 836 827 A1 | 10/1980 |
| EP | 38 11 400 A1 | 10/1989 |
| GB | 671221 | 4/1952 |
| GB | 686779 | 1/1953 |
| GB | 1039485 | 4/1965 |
| GB | 1455579 | 11/1976 |
| JP | 03000030 | 1/1991 |

* cited by examiner

*Primary Examiner*—Robert A. Hopkins
(74) *Attorney, Agent, or Firm*—Morrison & Foerster LLP

(57) ABSTRACT

The invention provides a cyclonic separating apparatus that includes a plurality of cyclones, each having an inlet and being arranged in parallel with one another, and a passageway arranged upstream of the cyclones for carrying an airflow to the inlets of the cyclones, wherein dividers are provided in the passageway for dividing the airflow within the passageway into a number of separate flowpaths, the number of flowpaths being equal to the number of cyclones, and wherein the cross-sectional area of each flowpath (142*a*), decreases along the direction of air flow. The invention also provides a method of operating a cyclonic separating apparatus (100) comprising a plurality of cyclones (104), each having an inlet and being arranged in parallel with one another, and a passageway (142) arranged upstream of the cyclones (104), the method comprising the steps of:(a) introducing a flow of dirt-laden air to the passageway (142); (b) dividing the flow of dirt-laden air into a plurality of airflow portions, the number of airflow portions being equal to the number of cyclones (104); and (c) reducing the cross-sectional area of each of the airflow portions in the direction of flow of the dirt-laden air.

30 Claims, 4 Drawing Sheets

CYCLONIC SEPARATING APPARATUS

FIELD OF THE INVENTION

The invention relates to cyclonic separating apparatus, particularly but not exclusively to cyclonic separating apparatus for use in vacuum cleaners. The invention also relates to a method of operating cyclonic separating apparatus of the aforementioned type.

BACKGROUND OF THE INVENTION

Cyclonic separating apparatus is well known and has uses in a wide variety of applications. Over the last decade or so, the use of cyclonic separating apparatus to separate particles from an airflow in a vacuum cleaner has been developed and introduced to the market. Detailed descriptions of cyclonic separating apparatus for use in vacuum cleaners are given in, inter alia, U.S. Pat. No. 3,425,192, U.S. Pat. No. 4,373,228 and EP 0 042 723. From these and other prior art documents, it can be seen that it is known to provide two cyclone units in series so that the airflow passes sequentially through at least two cyclones. This allows the larger dirt and debris to be extracted from the airflow in the first cyclone, leaving the second cyclone to operate under optimum conditions and so effectively to remove very fine particles in an efficient manner. This type of arrangement has been found to be effective when dealing with airflows in which is entrained a variety of matter having a wide particle size distribution. Such is the case in vacuum cleaners.

It is also known to provide cyclonic separating apparatus in which a plurality of cyclones are arranged in parallel with one another, as in, for example, U.S. Pat. No. 2,874,801. Furthermore, it is known to provide such a plurality of parallel cyclones downstream of a single cyclone, as in, for example, U.S. Pat. No. 3,425,192. However, the entries to these parallel cyclones are commonly via a plenum chamber with which the inlets to the parallel cyclones communicate in a direct manner. Other arrangements of parallel cyclones include uniform ducts leading from a plenum chamber to the inlet of each cyclone: see, for example, U.S. Pat. No. 3,682,302.

The passage of the air through a plenum chamber often causes unnecessary pressure losses because the relatively small inlets to the parallel cyclones bring about sudden and quite dramatic changes in the cross-section of the airflow path along which the air is flowing. The overall efficiency of the cyclonic separating apparatus is therefore lower than necessary.

SUMMARY OF THE INVENTION

It is an object of the present invention to provide cyclonic separating apparatus comprising a plurality of cyclones arranged in parallel in which the air is presented to the inlets of the parallel cyclones with the minimum of pressure drop. It is a further object of the present invention to provide cyclonic separating apparatus comprising a plurality of cyclones arranged in parallel and having an improved inlet arrangement to the cyclones. It is a further object of the invention to provide cyclonic separating apparatus comprising a plurality of cyclones arranged in parallel in which the losses associated with the inlets to the cyclones are minimised. It is a further object of the invention to provide cyclonic separating apparatus comprising a plurality of cyclones arranged in parallel having an improved efficiency.

The invention provides cyclonic separating apparatus comprising a plurality of cyclones, each having an inlet and being arranged in parallel with one another, and a passageway arranged upstream of the cyclones for carrying an airflow to the inlets of the cyclones, wherein dividing means are provided in the passageway for dividing the airflow within the passageway into a number of separate flowpaths, the number of flowpaths being equal to the number of cyclones, and wherein the cross-sectional area of each flowpath decreases in the direction of flow therealong.

The arrangement allows the cross-sectional area of the flowpaths to be decreased gradually and in a controlled manner so that the losses associated with changes in cross-sectional area are minimised. Thus the losses previously associated with the inlet arrangement to a plurality of cyclones arranged in parallel can be kept to a minimum and this allows the overall efficiency of the cyclonic separation apparatus to be improved. Sudden changes to the cross-sectional area are avoided which leads to less turbulent flow and fewer losses.

It is advantageous if each flowpath remains separate from the remaining flowpaths between the point in the passageway at which the airflow is divided and the inlet of the respective cyclone. This discourages turbulent airflow along the flowpaths. It is also advantageous for the flowpaths to be the same length between the point in the passageway at which the airflow is divided and the inlet of the respective cyclone so as to discourage pressure differences between the cyclones.

In a preferred arrangement, the length of each flowpath is at least three, preferably four, more preferably five, times the effective radius of the flowpath at the inlet to the respective cyclone. This allows the cross-sectional area of each flowpath to be decreased gradually along the length thereof. In a preferred arrangement, the cross-sectional area of each flowpath decreases at a substantially constant rate along the length thereof.

It is advantageous for the cross-sectional area of each flowpath at the inlet to the respective cyclone to be no more that 40%, more advantageously 30%, still more advantageously 20%, of the cross-sectional area of the flowpath at the point in the passageway at which the airflow is divided. This arrangement ensures that the velocity of the airflow at the inlet to the respective cyclone is sufficiently high to ensure good separation efficiency in the cyclone.

Preferably, the dividing means comprise a plurality of barrier portions arranged in the passageway. The reduction in the cross-sectional area of the flowpaths is advantageously achieved by adjacent barrier portions approaching one another in the direction of flow along the passageway. In addition, each barrier portion incorporates a cyclone entry duct at or adjacent the downstream end thereof. These features, individually and in combination, allow the apparatus according to the invention to be manufactured for use.

The apparatus described above is advantageously put to use in a vacuum cleaner, more preferably a domestic vacuum cleaner. For packaging reasons, the number of cyclones and flowpaths which can be accommodated is limited; however, it is preferred that the number of cyclones and flowpaths is at least five, more preferably seven. It is also preferred that an upstream cyclone is arranged upstream of the cyclones. This allows the incoming airstream to be pre-cleaned by the upstream cyclone before entering the cyclones. The cyclones are thus able to operate under optimum conditions.

The invention also provides a method of operating cyclonic separating apparatus comprising a plurality of cyclones, each having an inlet and being arranged in parallel with one another, and a passageway arranged upstream of the cyclones, the method comprising the steps of:

(a) introducing a flow of dirt-laden air to the passageway;

(b) dividing the flow of dirt-laden air into a plurality of flowpaths, the number of flowpaths being equal to the number of cyclones; and (c) reducing the cross-sectional area of each of the flowpaths in the direction of flow of the dirt-laden air.

The method allows the cross-sectional area of the flowpaths to be decreased gradually and in a controlled manner so that the losses associated with changes in cross-sectional area are minimised, resulting in increased efficiency of the cyclonic separating apparatus.

It is preferred that the cross-sectional area of each flowpath is reduced by at least 60%, preferably at least 70%, more preferably at least 80%, before the dirt-laden air reaches the inlet of the respective cyclone. This ensures that the velocity of the airflow at the inlet to the respective cyclone is sufficiently high to ensure good separation efficiency in the cyclone. It is also preferred, although not essential, that the cross-sectional area of each flowpath is reduced at a substantially constant rate so as to encourage smooth airflow along each flowpath, resulting in reduced losses.

In a preferred embodiment, the dirt-laden air is passed through an upstream cyclone before being passed to the passageway. This allows the cyclones to operate under optimum conditions by virtue of the fact that the upstream cyclone will remove larger dirt and debris from the dirt-laden air before it passes into the cyclones.

BRIEF DESCRIPTION OF THE DRAWINGS

An embodiment of the invention will now be described with reference to the accompanying drawings, wherein.

DETAILED DESCRIPTION OF THE INVENTION

Figure 1A:
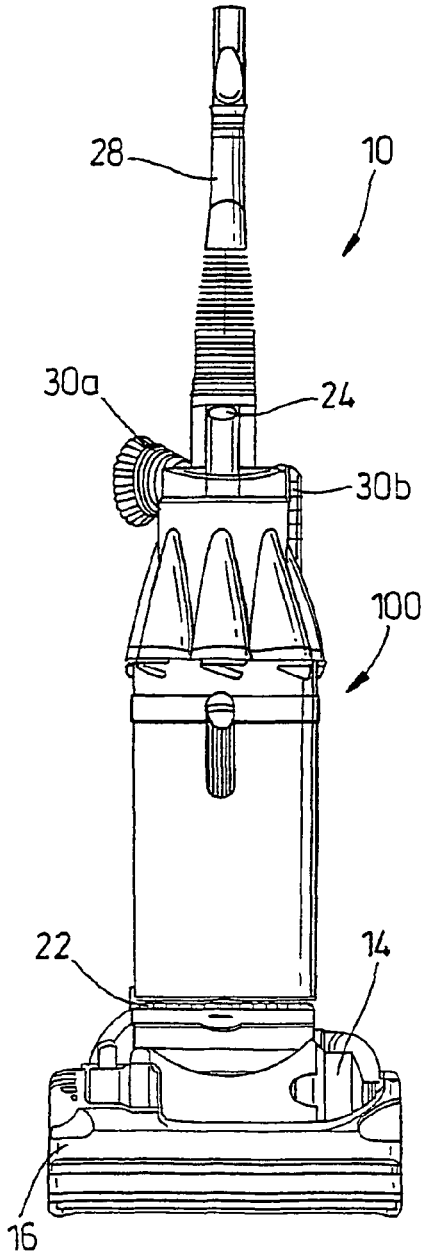
FIGS. 1*a* and 1*b* are front and side views, respectively, of a vacuum cleaner incorporating cyclonic separating apparatus according to the invention.
Figure 1B:
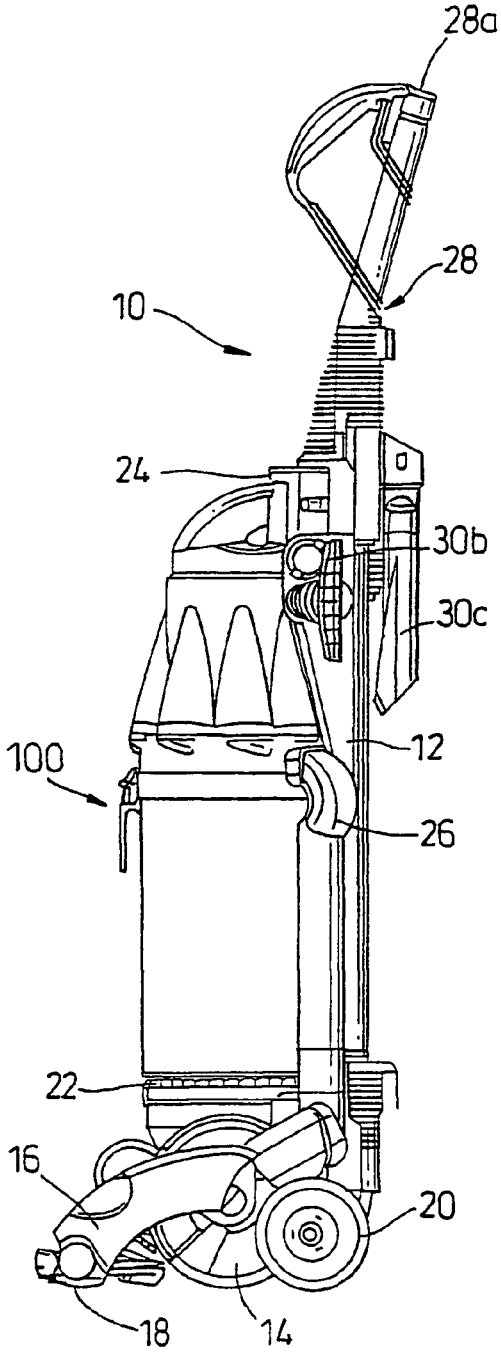

FIGS. 1*a* and 1*b* show a domestic vacuum cleaner 10 incorporating cyclonic separating apparatus according to the present invention. The vacuum cleaner 10 comprises an upstanding body 12 at a lower end of which is located a motor casing 14. A cleaner head 16 is mounted in an articulated fashion on the motor casing 14. A suction inlet 18 is provided in the cleaner head 16 and wheels 20 are rotatably mounted on the motor casing 14 to allow the vacuum cleaner 10 to be manoeuvered over a surface to be cleaned.

Cyclonic separating apparatus 100 is mounted on the upstanding body 12 above the motor casing 14. The cyclonic separating apparatus 100 is seated on a generally horizontal surface formed by a filter cover 22. The filter cover 22 is located above the motor casing 14 and provides a cover for a post-motor filter (not shown). The cyclonic separating apparatus 100 is also secured to the upstanding body 12 by means of a clip 24 located at the top of the cyclonic separating apparatus 100. The upstanding body 12 incorporates upstream ducting (not shown) for carrying dirty air to an inlet of the cyclonic separating apparatus 100 and downstream ducting 26 for carrying cleaned air away from the cyclonic separating apparatus 100.

The upstanding body 12 further incorporates a hose and wand assembly 28 which may be retained in the configuration shown in the drawings so as to function as a handle for manoeuvering the vacuum cleaner 10 over a surface to be cleaned. Alternatively, the hose and wand assembly 28 may be released to allow the distal end 28*a* of the wand to be used in conjunction with a floor tool (not shown) to perform a cleaning function, eg on stairs, upholstery, etc. The structure and operation of the hose and wand assembly 28 is not material to the present invention and will not be described any further here. The general structure and operation of the hose and wand assembly 28 illustrated in FIGS. 1*a* and 1*b* is similar to that described in U.S. Pat. No. Re 32,257 which is incorporated herein by reference. Also, several tools and accessories 30*a*, 30*b*, 30*c*, are releasably mounted on the upstanding body 12 for storage purposes between periods of use.

The precise details of the features of the vacuum cleaner 10 described above are not material to the present invention. The invention is concerned with the details of the cyclonic separation apparatus 100 forming part of the vacuum cleaner 10. In order for the cyclonic separation apparatus 100 to be brought into operation, the motor located in the motor casing 14 is activated so that air is drawn into the vacuum cleaner via either the suction inlet 18 or the distal end 28*a* of the hose and wand assembly 28. This dirty air (being air having dirt and dust entrained therein) is passed to the cyclonic separation apparatus 100 via the upstream ducting. After the air has passed through the cyclonic separation apparatus 100, it is ducted out of the cyclonic separating apparatus 100 and down the upstanding body 12 to the motor casing 14 via the downstream ducting 26. The cleaned air is used to cool the motor located in the motor casing 14 before being exhausted from the vacuum cleaner 10 via the filter cover 22.

This principle of operation of the vacuum cleaner 10 is known from the prior art. This invention is concerned with the cyclonic separation apparatus 100 which is illustrated in FIGS. 2*a*, 2*b* and 3 in isolation from the vacuum cleaner 10.

Figure 2A:
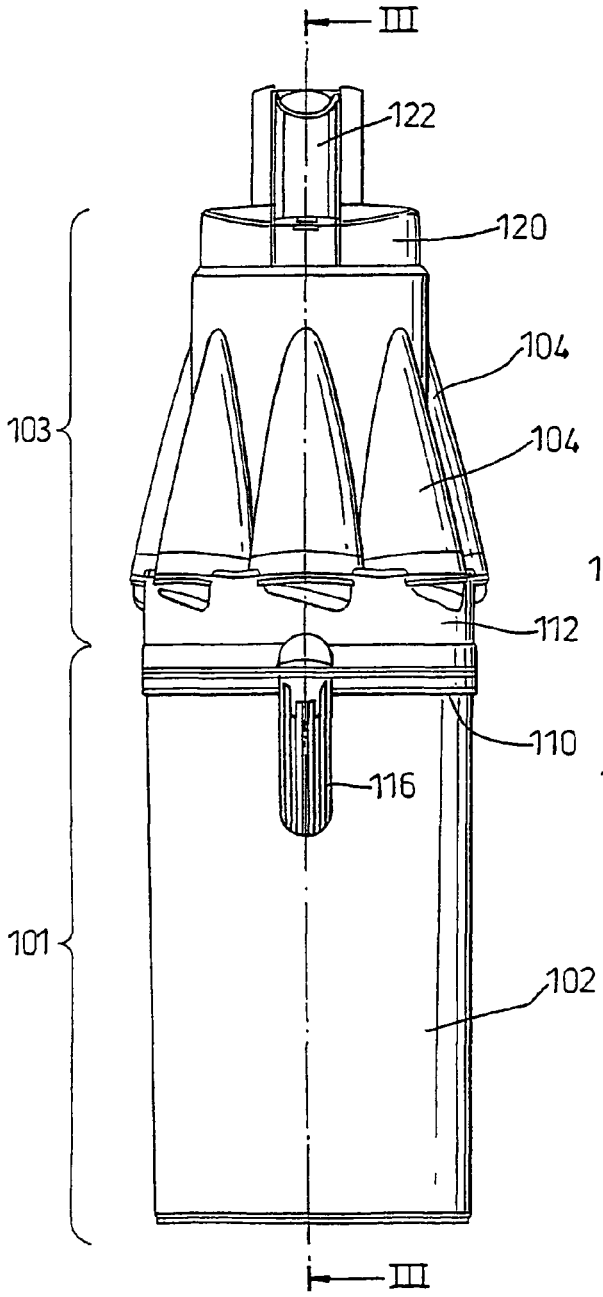
FIGS. 2*a* and 2*b* are front and plan views, respectively, of cyclonic separating apparatus forming part of the vacuum cleaner of FIGS. 1*a* and 1*b;*
Figure 2B:
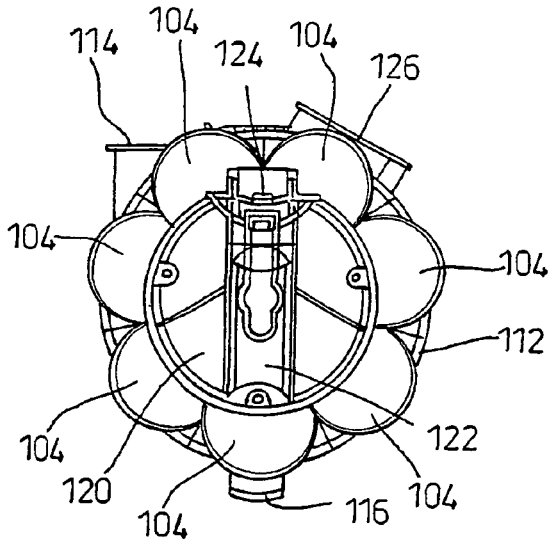
Figure 3:
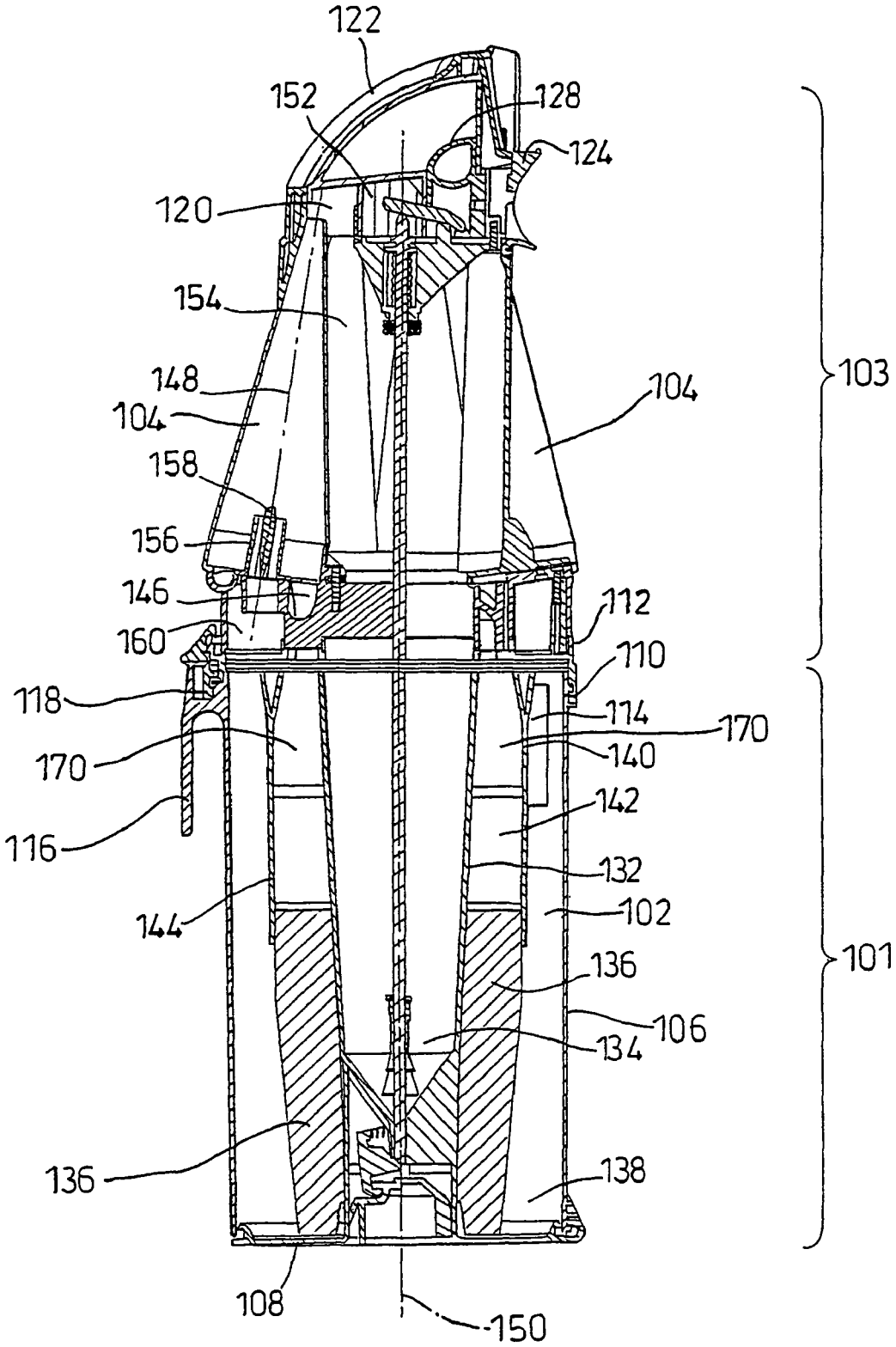
FIG. 3 is a sectional side view of the cyclonic separating apparatus of FIGS. 2*a* and 2*b*, taken along the line III—III of FIG. 2*a*.

The cyclonic separation apparatus 100 illustrated in FIGS. 2*a*, 2*b* and 3 comprises an upstream cyclone unit 101 consisting of a single upstream cyclone 102 and a downstream cyclone unit 103 consisting of a plurality of downstream cyclones 104. The upstream cyclone 102 consists essentially of a cylindrical bin 106 having a closed base 108. The open upper end 110 of the cylindrical bin abuts against a circular upper moulding 112 which defines an upper end of the upstream cyclone 102. An inlet port 114 is provided in the cylindrical bin 106 in order to allow dirty air to be introduced to the interior of the upstream cyclone 102. The inlet port 114 is shaped, positioned and configured to communicate with the upstream ducting which carries dirt-laden air from the cleaner head 16 to the cyclonic separating apparatus 100. A handle 116 and a catch 118 are provided on the cylindrical bin 106 and the upper moulding 112 respectively in order to provide means for releasing the cylindrical bin 106 from the upper moulding 112 when the cylindrical bin 106 requires to be emptied. A seal (not shown) can be provided between the cylindrical bin 106 and the upper moulding 112 if required.

The base 108 of the cylindrical bin can be hingedly connected to the remainder of the cylindrical bin in order to provide further access to the interior of the cylindrical bin 106 for emptying purposes if required. The embodiment illustrated herein will include a mechanism for allowing the base 108 to be hingedly opened in order to allow emptying, but the details of such a mechanism form the subject of a copending application and will not be described for any reason other than explanation of the drawings.

Seven identical downstream cyclones 104 are provided in the downstream cyclone unit 103. The downstream cyclones 104 are equi-angularly spaced about the central longitudinal axis 150 of the downstream cyclone unit 103, which is coincident with the longitudinal axis of the upstream cyclone unit 101. The arrangement is illustrated in FIG. 3. Each downstream cyclone 104 is frusto-conical in shape with the larger end thereof located lowermost and the smaller end uppermost. Each downstream cyclone 104 has a longitudinal axis 148 (see FIG. 3) which is inclined slightly towards the longitudinal axis 150 of the downstream cyclone unit 103. This feature will be described in more detail below. Also, the outermost point of the lowermost end of each downstream cyclone 104 extends radially further from the longitudinal axis 150 of the downstream cyclone unit 103 than the wall of the cylindrical bin 106. The uppermost ends of the downstream cyclones 104 project inside a collection moulding 120 which extends upwardly from the surfaces of the downstream cyclones 104. The collection moulding 120 supports a handle 122 by means of which the entire cyclonic separation apparatus 100 can be transported. A catch 124 is provided on the handle 122 for the purposes of securing the cyclonic separation apparatus 100 to the upstanding body 12 at the upper end thereof. An outlet port 126 is provided in the upper moulding 112 for conducting cleaned air out of the cyclonic separating apparatus 100. The outlet port 126 is arranged and configured to co-operate with the downstream ducting 26 for carrying the cleaned air to the motor casing 14.

The collection moulding 120 also carries an actuating lever 128 designed to activate a mechanism for opening the base 108 of the cylindrical bin 106 for emptying purposes as mentioned above.

The internal features of the upstream cyclone 102 include an internal wall 132 extending the entire length thereof. The internal space defined by the internal wall 132 communicates with the interior of the collection moulding 120 as will be described below. The purpose of the internal wall 132 is to define a collection space 134 for fine dust. Located inside the internal wall 132 and in the collection space 134 are components for allowing the base 108 to open when the actuating lever 128 is actuated. The precise details and operation of these components is immaterial to the present invention and will not be described any further here.

Mounted externally of the internal wall 132 are four equi-spaced baffles or fins 136 which project radially outwardly from the internal wall 132 towards the cylindrical bin 106. These baffles 136 assist with the deposition of large dirt and dust particles in the collection space 138 defined between the internal wall 132 and the cylindrical bin 106 adjacent the base 108. The particular features of the baffles 136 are described in more detail in WO 00/04816.

Located outwardly of the internal wall 132 in an upper portion of the upstream cyclone 102 is a shroud 140. The shroud extends upwardly from the baffles 136 and, together with the internal wall 132, defines an air passageway 142. The shroud 140 has a perforated portion 144 allowing air to pass from the interior of the upstream cyclone 102 to the air passageway 142. The air passageway 142 communicates with the inlet 146 of each of the downstream cyclones 104. Each inlet 146 is arranged in the manner of a scroll so that air entering each downstream cyclone 104 is forced to follow a helical path within the respective downstream cyclone 104.

Figure 4:
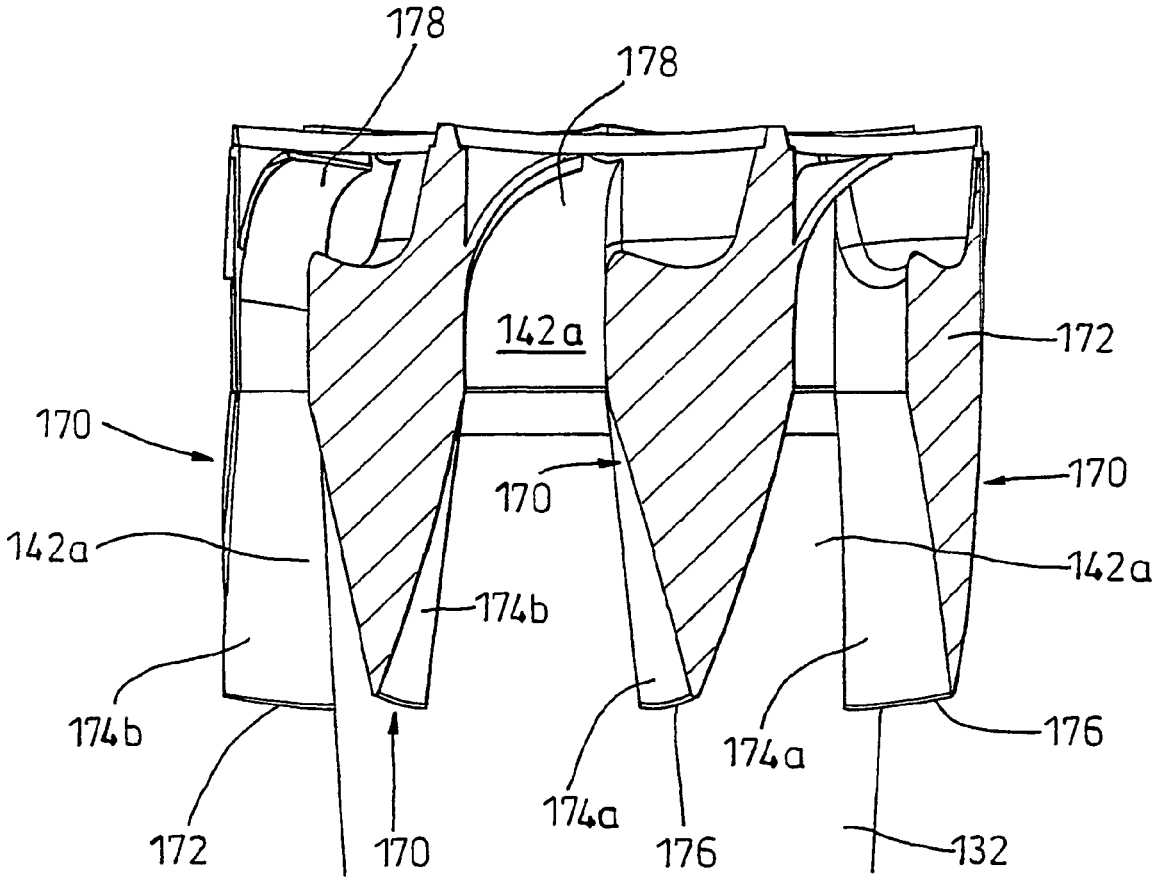
FIG. 4 is a side view, on an enlarged scale, of a part of the cyclonic separating apparatus of FIGS. 2*a*, 2*b* and 3.

Inside the passageway 142 are a plurality of barrier members 170. The barrier members 170 are arranged between the upper portion of the shroud 140 and the upper portion of the internal wall 132 and are equi-spaced about the axis 150. Seven barrier members 170 are provided in total. FIG. 4 is a side view of the upper portion of the internal wall and four of the seven barrier members 170 showing the relationship of the barrier members 170 to one another and to the upper portion of the internal wall 132. The upper portion of the shroud 140 has been omitted from FIG. 4 for the sake of clarity. However, when the barrier members 170 are located in the separating apparatus 100 as described, the radially outermost walls 172 of each barrier member 170 (shown shaded in FIG. 4) will either abut against or be formed integrally with the shroud 140. Each barrier member 170 comprises a radially outermost wall 172 (as described above) and side walls 174*a*, 174*b* which extend between the radially outermost wall 172 and the surface of the internal wall 132. The radially outermost wall 172 is generally triangular in shape with the tapering end pointing downwards. The side walls 174*a*, 174*b* meet to form a sharp edge 176 adjacent the tapering end of the radially outermost wall 172 so as to give each barrier member 170 a generally wedge-shaped configuration. The barrier members 170 and their arrangement between the shroud 140 and the internal wall 132 and about the axis 150 cause the downstream portion of the passageway 142 to be divided into seven flowpaths 142*a*. Each flowpath 142*a* is located between a pair of adjacent barrier members 170 and is substantially identical in length and configuration to the remaining flowpaths 170. The generally wedge-shaped configuration of the barrier members 170 means that the cross-sectional area of each flowpath 142*a* decreases in a direction away from the sharp edge 176. The rate of decrease of the cross-sectional area of each flowpath 142*a* is substantially constant, at least over the majority of the length thereof.

Each flowpath 142*a* includes, at its downstream end, a cyclone entry duct 178 which opens into the respective cyclone 104 via a cyclone inlet. The cyclone inlet is the point in the duct 178 furthest downstream at which the duct 178 is delimited on all sides by a solid wall. Beyond the cyclone inlet, the airflow passing along the duct 178 is physically unrestrained, at least in part. In the embodiment shown, the cyclone inlet is generally parallel to the uppermost portion of the side wall 174*a* of the barrier member 170 defining the flowpath 142*a* which leads to the respective cyclone inlet. The duct 178 is shaped and configured so as to force the airflow passing therealong to enter the cyclone 104 in a helical manner in order to effect cyclonic separation therein. The duct 178 can be arranged so as to effect a tangential entry to the cyclone 104 or, as been mentioned above, can also be arranged to effect a scroll entry.

The cyclone inlet need not be circular in shape. Indeed, in the embodiment illustrated, the cyclone inlet is roughly U-shaped. However, it is possible to calculate an effective radius of the cyclone inlet by taking the actual cross-sectional area and assuming that it is in fact circular in shape. Hence, using the formula area=$\pi\times$radius$^2$, the effective radius of the cyclone inlet can be calculated. In the embodiment shown, the actual area of the cyclone inlet is 180 mm$^2$, which gives an effective radius of 7.57 mm. The length of the flowpath 142*a*, measured from the point in the passageway 142 at which the airflow is divided to the cyclone inlet, is at least five times the effective radius of the cyclone inlet. It is preferred that the length of the flowpath 142*a* is at least seven times the effective radius of the cyclone inlet. In the embodiment shown, the length of the flowpath 142*a* is approximately 68 mm, which is approximately 9 times the effective radius of the cyclone inlet.

The relative dimensions described above allow the decrease in cross-sectional area of the flowpath 142*a* to be gradual and the rate of decrease to be substantially constant. The result is that the airflow passing along the flowpath 142*a* increases in velocity without suffering excessively high losses in the process.

In the embodiment, the cross-sectional area of each of the flowpaths 142*a*, measured at the point in the passageway 142 at which the airflow is divided, is approximately 985 $mm^2$. If the cross-sectional area of the cyclone inlet is 180 $mm^2$, then this represents a reduction in cross-sectional area of approximately 80%. In other embodiments which are not illustrated here, the decrease can be somewhat less than 80%, 70% and 60% being acceptable reductions in area. Hence, the cross-sectional area of the cyclone inlet can be between 60% and 80% of the area of the flowpath 142*a* at the point in the passageway 142 at which the airflow is divided.

As previously mentioned, the longitudinal axis 148 of each downstream cyclone 104 is inclined towards the longitudinal axis 150 of the downstream cyclone unit 103. The upper end of each downstream cyclone 104 is closer to the longitudinal axis 150 than the lower end thereof. In this embodiment, the angle of inclination of the relevant axes 148 is substantially 7.5°.

The upper ends of the downstream cyclones 104 project inside the collection moulding 120, as previously mentioned. The interior of the collection moulding 120 defines a chamber 152 with which the upper ends of the downstream cyclones 104 communicate. The collection moulding 120 and the surfaces of the downstream cyclones 104 together define an axially extending passageway 154, located between the downstream cyclones 104, which communicates with the collection space 134 defined by the internal wall 132. It is thus possible for dirt and dust which exits the smaller ends of the downstream cyclones 104 to pass from the chamber 152 to the collection space 134 via the passageway 154.

Each downstream cyclone 104 has an air exit in the form of a vortex finder 156. Each vortex finder 156 is located centrally of the larger end of the respective downstream cyclone 104, as is the norm. In this embodiment, a centre body 158 is located in each vortex finder 156. Each vortex finder communicates with an annular chamber 160 which, in turn, communicates with the outlet port 126.

The mode of operation of the apparatus described above is as follows. Dirty air (being air in which dirt and dust is entrained) enters the cyclonic separating apparatus 100 via the inlet port 114. The arrangement of the inlet port 114 is essentially tangential to the wall of the cylindrical bin 106 which causes the incoming air to follow a helical path around the inside of the cylindrical bin 106. Larger dirt and dust particles, along with fluff and other large debris, are deposited in the collection space 138 adjacent the base 108 by virtue of the effect of centrifugal forces acting on the particles, as is well known. Partially cleaned air travels inwardly and upwardly away from the base 108, exiting the upstream cyclone 102 via the perforated portion 144 of the shroud 140 and passing into the air passageway 142.

Once inside the passageway 142, the partially cleaned air moves upwardly parallel to the axis 150 and is divided into seven airflow portions as it passes the sharp edges 176 at the lowermost points of the barrier members 170. Each individual airflow portion then passes along the respective flowpath 142*a*. In doing so, the cross-sectional area airflow portion is reduced by virtue of the fact that the cross-sectional area of the respective flowpath 142*a* is reduced. The rate of decrease is governed by the shape and configuration of the barrier members 170 and, in the case of the embodiment shown in the drawings, the rate of decrease is substantially constant, at least whilst the airflow portion flows along the majority of the length of the flowpath 142*a*.

Depending upon the shape and configuration of the flowpath 142*a*, the airflow portion decreases in cross-sectional area by at least 60% between the time at which it enters the flowpath 142*a* and the cyclone inlet. In the embodiment shown, the percentage reduction in cross-sectional area is approximately 80%. This ensures that the airflow portion is traveling at a relatively high velocity as it exits the flowpath 142*a* and enters the respective cyclone 104.

Each airflow portion enters one of the downstream cyclones 104 via the respective inlet 146. As has been mentioned above, each inlet 146 is a scroll inlet which forces the incoming air to follow a helical path inside the downstream cyclone 104. The tapering shape of the downstream cyclone 104 causes further, intense cyclonic separation to take place inside the downstream cyclone 104 so that very fine dirt and dust particles are separated from the main airflow. The dirt and dust particles exit the uppermost end of the respective downstream cyclone 104 whilst the cleaned air returns to the lower end of the downstream cyclone 104 along the axis 148 thereof and exits via the vortex finder 156. The cleaned air passes from the vortex finder 156 into the annular chamber 162 and from there to the outlet port 126. Meanwhile, the dirt and dust which has been separated from the airflow in the downstream cyclone 104 falls from the chamber 152 through the passage-way 154 to the collection space 134.

When it is desired to empty the cyclonic separating apparatus 100, the base 108 can be hingedly released from the sidewall of the cylindrical bin 106 so that the dirt and debris collected in collection spaces 134 and 138 can be allowed to drop into an appropriate receptacle. As previously explained, the detailed operation of the emptying mechanism does not form part of the present invention and will not be described any further here.

It will be appreciated that the invention need not be confined to the precise details of the embodiment described above. Various alterations and variations may be made without departing from the scope of the invention. For example, the number of downstream cyclones 104 shown in the embodiment is seven. However, there is no particular limit to the number of downstream cyclones which can be provided, or indeed to their arrangement with respect to one another or to the upstream cyclone. The downstream cyclones can thus be varied in number and arrangement. Also, the precise manner in which the airflow is divided within the passageway is not critical, although the reduction of the cross-sectional area of each flowpath is necessary in order to achieve the aims of the invention. It is envisaged that the invention may have applications in field other than the vacuum cleaner industry.

What is claimed is:

1. A cyclonic separating apparatus comprising a plurality of cyclones, each of the cyclones having a single inlet and being arranged in parallel with one another, a passageway upstream of the cyclones for carrying an airflow to the inlets of the cyclones and dividers provided in the passageway for dividing the airflow within the passageway into a number of separate flowpaths, the number of flowpaths being equal to the number of cyclones, and wherein the cross-sectional area of each flowpath decreases in the direction of the airflow toward each inlet.

2. A cyclonic separating apparatus, comprising a plurality of cyclones, each having an inlet and being arranged in parallel with one another, a passageway upstream of the cyclones for carrying an airflow to the inlets of the cyclones and dividers provided in the passageway for dividing the airflow within the passageway into a number of separate flowpaths, the number of flowpaths being equal to the number of cyclones, and wherein the cross-sectional area of each flowpath decreases in the direction of the airflow along each flowpath, wherein the length of each flowpath is at least five times the effective radius of the flowpath at the inlet of the respective cyclone.

3. The cyclonic separating apparatus as claimed in claim 1, wherein each flowpath is separate from the remaining flowpaths between the point in the passageway at which the airflow is divided and the inlet of the respective cyclone.

4. The cyclonic separating apparatus as claimed in claim 3, wherein each flowpath is the same length as the remaining flowpaths between the point in the passageway at which the airflow is divided and the inlet of the respective cyclone.

5. The cyclonic separating apparatus as claimed in claim 4, wherein the length of each flowpath is at least five times the effective radius of the flowpath at the inlet of the respective cyclone.

6. The cyclonic separating apparatus as claimed in claim 5 or 2, wherein the length of each flowpath is at least seven times the effective radius of the flowpath at the inlet of the respective cyclone.

7. The cyclonic separating apparatus as claimed in claim 6, wherein the length of each flowpath is at least nine times the effective radius of the flowpath at the inlet of the respective cyclone.

8. The cyclonic separating apparatus as claimed in claim 1, 3, 4, 5 or 2, wherein the cross-sectional area of each flowpath decreases at a substantially constant rate along a majority of the length thereof.

9. The cyclonic separating apparatus as claimed in claim 8, wherein the cross-sectional area of each flowpath at the inlet to the respective cyclone is no more than 40% of the cross-sectional area of the flowpath at the point in the passageway at which the airflow is divided.

10. The cyclonic separating apparatus as claimed in claim 8, wherein the cross-sectional area of each flowpath at the inlet to the respective cyclone is no more than 30% of the cross-sectional area of the flowpath at the point in the passageway at which the airflow is divided.

11. The cyclonic separating apparatus as claimed in claim 8, wherein the cross-sectional area of each flowpath at the inlet to the respective cyclone is no more than 20% of the cross-sectional area of the flowpath at the point in the passageway at which the airflow is divided.

12. The cyclonic separating apparatus as claimed in claim 1, 3, 4, 5 or 2, wherein the dividers comprise barrier members arranged in the passageway.

13. The cyclonic separating apparatus as claimed in claim 12, wherein adjacent barrier members approach one another in the direction of flow along the passageway.

14. The cyclonic separating apparatus as claimed in claim 12, wherein each barrier member incorporates a cyclone entry duct at or adjacent the downstream end thereof.

15. The cyclonic separating apparatus as claimed in claim 1, 3, 4, 5 or 2, wherein the number of cyclones and flowpaths is greater than five.

16. The cyclonic separating apparatus as claimed in claim 1, 3, 4, 5 or 2, wherein the number of cyclones and flowpaths is seven.

17. The cyclonic separating apparatus as claimed in claim 1, 3, 4, 5 or 2, wherein the cyclones are equiangularly spaced about a longitudinal axis of the cyclonic separating apparatus.

18. The cyclonic separating apparatus as claimed in claim 1, 3, 4, 5 or 2, further comprising an upstream cyclone arranged upstream of the plurality of cyclones.

19. The cyclonic separating apparatus as claimed in claim 13, wherein each barrier member incorporates a cyclone entry duct at or adjacent the downstream end thereof.

20. A method of operating a cyclonic separating apparatus comprising a plurality of cyclones, each of the cyclones having a single inlet and being arranged in parallel with one another, and a passageway arranged upstream of the cyclones, comprising:

(a) introducing a flow of dirt-laden air to the passageway;

(b) dividing the flow of dirt-laden air into a plurality of airflow portions, the number of airflow portions being equal to the number of cyclones; and (c) reducing the cross-sectional area of each of the airflow portions in the direction of flow of the dirt-laden air.

21. A method as claimed in claim 20, wherein the cross-sectional area of each airflow portion is reduced by at least 60% before the dirt-laden air reaches the inlet of the respective cyclone.

22. A method as claimed in claim 21, wherein the cross-sectional area of each airflow portion is reduced by at least 70% before the dirt-laden air reaches the inlet of the respective cyclone.

23. A method as claimed in claim 22, wherein the cross-sectional area of each airflow portion is reduced by at least 80% before the dirt-laden air reaches the inlet of the respective cyclone.

24. A method as claimed in any one of claims 20 to 23, wherein the cross-sectional area of each airflow portion is reduced at a substantially constant rate.

25. A method as claimed in any one of claims 20 to 23, wherein the dirt-laden air is passed through an upstream cyclone before being passed to the passageway.

26. A vacuum cleaner comprising a cyclonic separating apparatus comprising a plurality of cyclones, each having an inlet and being arranged in parallel with one another, a passageway upstream of the cyclones for carrying an airflow to the inlets of the cyclones and dividers provided in the passageway for dividing the airflow within the passageway into a number of separate flowpaths, the number of flowpaths being equal to the number of cyclones, and wherein the cross-sectional area of each flowpath decreases in the direction of the airflow along each flowpath.

27. A vacuum cleaner as claimed in claim 26, wherein the length of each flowpath is at least five times the effective radius of the flowpath at the inlet of the respective cyclone.

28. A vacuum cleaner as claimed in claim 26, wherein the cross-sectional area of each flowpath decreases at a substantially constant rate along a majority of the length thereof and wherein the cross-sectional area of each flowpath at the inlet to the respective cyclone is no more than 40% of the cross-sectional area of the flowpath at the point in the passageway at which the airflow is divided.

29. A vacuum cleaner as claimed in claim 26, wherein the number of cyclones and flowpaths is greater than five.

30. A vacuum cleaner as claimed in claim 26, wherein the cyclones are equiangularly spaced about a longitudinal axis of the cyclonic separating apparatus.

* * * * *

UNITED STATES PATENT AND TRADEMARK OFFICE

CERTIFICATE OF CORRECTION

PATENT NO. : 6,989,039 B2
APPLICATION NO. :10/474684
DATED : January 24, 2006
INVENTOR(S) : Remco Douwinus Vuijk It is certified that error appears in the above-identified patent and that said Letters Patent is hereby corrected as shown below:

On the Title Page, item (73) Under Assignee:

Delete "Dyson Limited" and replace with --Dyson Technology Limited--

Signed and Sealed this

Thirtieth Day of January, 2007

JON W. DUDAS
*Director of the United States Patent and Trademark Office*